US006428178B1

(12) United States Patent
Rubin

(10) Patent No.: US 6,428,178 B1
(45) Date of Patent: Aug. 6, 2002

(54) COMBINATION LIGHTING DEVICE

(76) Inventor: Robert S. Rubin, 960 N. Lake Shore Dr., Lake Bluff, IL (US) 60044

( * ) Notice: Subject to any disclaimer, the term of this patent is extended or adjusted under 35 U.S.C. 154(b) by 0 days.

(21) Appl. No.: 09/472,047

(22) Filed: Dec. 27, 1999

(51) Int. Cl.[7] ..... F21V 21/08
(52) U.S. Cl. ..... 362/103; 362/191; 362/396
(58) Field of Search ..... 362/103, 104, 362/800, 391, 396, 190, 191

(56) References Cited

U.S. PATENT DOCUMENTS

| | | | | |
|---|---|---|---|---|
| 4,047,150 A | | 9/1977 | Kelley | 340/84 |
| 4,237,515 A | * | 12/1980 | Deter | 362/104 |
| 4,930,052 A | * | 5/1990 | Beige | 362/104 |
| 5,918,964 A | | 7/1999 | Bou | 362/186 |
| 6,013,346 A | * | 1/2000 | Lewis et al. | 428/78 |

* cited by examiner

*Primary Examiner*—Sandra O'Shea
*Assistant Examiner*—John Anthony Ward
(74) *Attorney, Agent, or Firm*—Mark E. Wiemelt

(57) ABSTRACT

A combination lighting device 10 adapted for use inside a carved pumpkin 11, as a necklace 38 and on an article of clothing 13 that comprises a front housing 12 that allows light to pass therethrough, a stem portion 14 having an aperture 34 and being attached to a top edge of the front housing 12 so that a piece of string 36 may pass horizontally through the aperture 34 for use as a necklace 38, a back panel 16 being sized to removably engage an inner side 40 of the back panel 16 with an inner side 32 of the front housing 12, means 18 for lighting the front housing 12, means 20 for powering the lighting means 18, means 22 for activating the lighting means 18, and means 24 for removably securing the lighting device 10 within the pumpkin 11 and to the article of clothing 13.

17 Claims, 5 Drawing Sheets

COMBINATION LIGHTING DEVICE

BACKGROUND OF THE INVENTION

Halloween is a festive time for children because they have an opportunity to receive candy and dress up in costumes when trick-or-treating. In addition to wearing costumres, the children can further enliven their spooky fantasies by carving pumpkins into jack-o-lanterns and putting up paper posters depicting ghosts and goblins around their homes. In spite of the joyous mood of this time of year, there are safety concerns of which most parents, if not all people, are aware. For one, after carving pumpkins into scary or funny faces, most people add to the aura of the jack-o-lanterns by inserting candles inside of the pumpkins. The potential hazard of inserting candles and dealing with fire is that the fire may become uncontrollable during an accident. This could result in damage to homes or other objects and injury or, worse yet, death to people. Hence, there is a need in the art for a device that lights a carved pumpkin without the dangers of using candles.

Another danger involves children traveling in various neighborhoods and from house to house to trick-or-treat in search of candies, chocolates and other "goodies." Often parents accompany their children on these expeditions to ensure the latters' safety. Since most children go trick-or-treating at night, the ability of drivers and other pedestrians to see the children depends invariably on the lighting available on sidewalks and road sides. To overcome the dark of night, some trick-or-treaters bring flashlights on Halloween night. However, for children to carry both a bag of candy and a flashlight may be impractical and cumbersome. As a result, there is also a need in the art for a device that provide a source of light to protect children, to not hinder their trick-or-treating experience, and to make sure that they are visible to other trick-or-treaters, drivers and other pedestrians.

BRIEF SUMMARY OF THE INVENTION

The instant invention comprises a novel combination lighting device 10 that may be securely inserted inside a carved pumpkin 11, used as a necklace 38 and secured onto an article of clothing 13. The disclosed invention alleviates the shortcomings of existing devices in that it replaces the use of unsafe candles to light carved pumpkins 11 and provides a convenient safetly light for children, and other individuals, who are travelling on foot or on bicycles during the night or when trick-or-treating.

One embodiment of the present invention comprises a front housing 12 having a top edge 26, a bottom edge 28, an outer side 30 and an inner side 32. The front housing 12 is translucent, oranged-colored, and shaped like a pumpkin 11 with a jack-o-lantern face 31 on the outer side 30 thereof. A stem portion 14 having a horizontal aperture 34 is attached on the top edge 26 of the front housing 12. This aperture 34 allows a piece of string 36 to pass therethrough so that a necklace 38 may be formed.

A back panel 16 sized to fit inside the front housing 12 has an inner side 40 and an outer side 42, whereby the inner side 40 faces the inner side 32 of the front housing 12 when removably engaged thereto. Attached to the inner side 40 of the back panel 16 comprises a lighting means 18 that emits light through the front housing 12, a powering means 20 that provides power to the lighting means 18, and an activating means 22 that activates the lighting means 18. Conversely, attached to the outer side 42 of the back panel 16 comprises a securing means 24 that removably secures the lighting device 10 optionally either inside of the carved pumpkin 11 or onto the article of clothing 13.

It is, therefore, an object of the present invention to teach a novel combination lighting device that may be used for many purposes during nighttime.

Another object of this invention is to teach a combination lighting device that may be used safely during Halloween for multiple purposes.

It is also an object of the instant invention is to teach a combination lighting device that may be used as a safe alternative to candle lighting inside of carved pumpkins.

A further object of the disclosed invention is to teach a combination lighting device that may be worn as a necklace when trick-or-treating.

It is another object of the instant invention to teach a combination lighting device that may be worn on one's clothing when trick-or-treating.

There has thus been outlined, rather broadly, the more important features of the invention in order that the detailed description thereof that follows may be better understood, and in order that the present contribution to the art may be better appreciated. There are, of course, additional features of the invention that will be described hereinafter and that will form the subject matter of the invention. Those skilled in the art will appreciate that the conception, upon which this disclosure is based, may readily be utilized as a basis for the designing of other devices for carrying out the several purposes of the present invention. It is important, therefore, that the invention be regarded as including such equivalent constructions insofar as they do not depart from the spirit and scope of the present disclosure.

FIG, 4 illustrates a back view of the novel combination lighting device.

Figure 5:
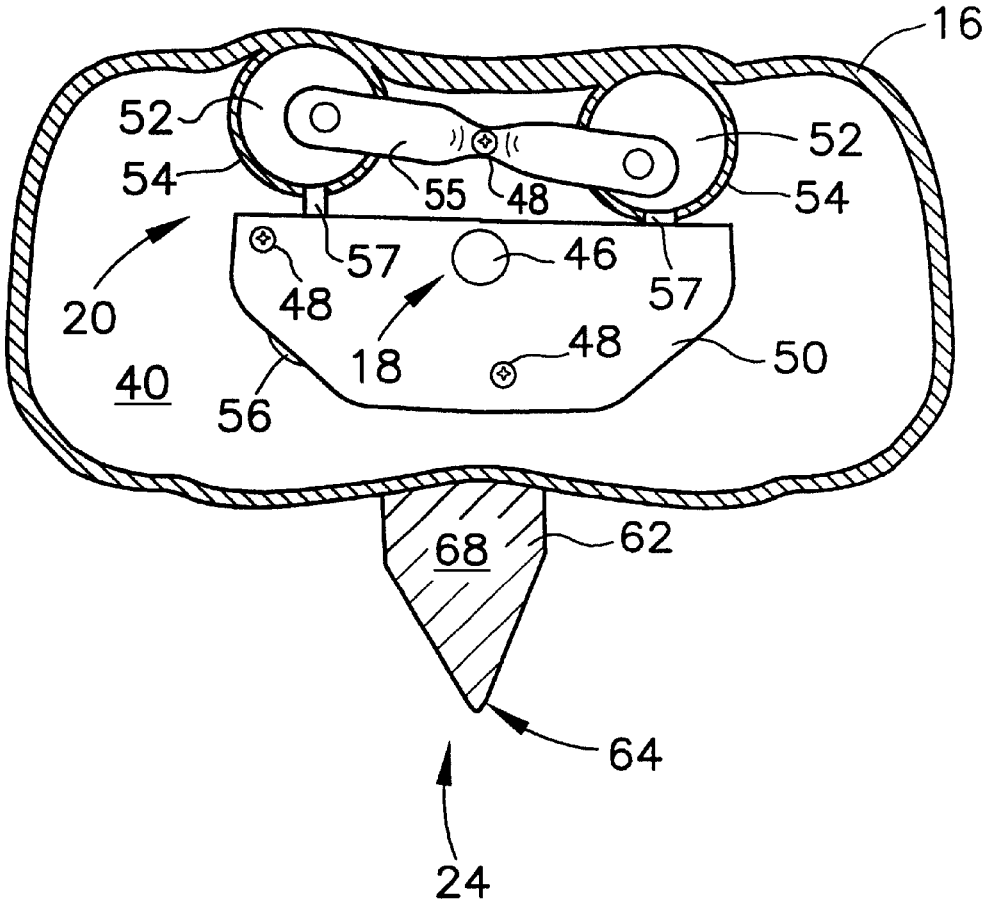

FIG. 5 illustrates a front view of the back panel used in the novel combination lighting device.

DETAILED DESCRIPTION OF THE INVENTION

Figure 1:
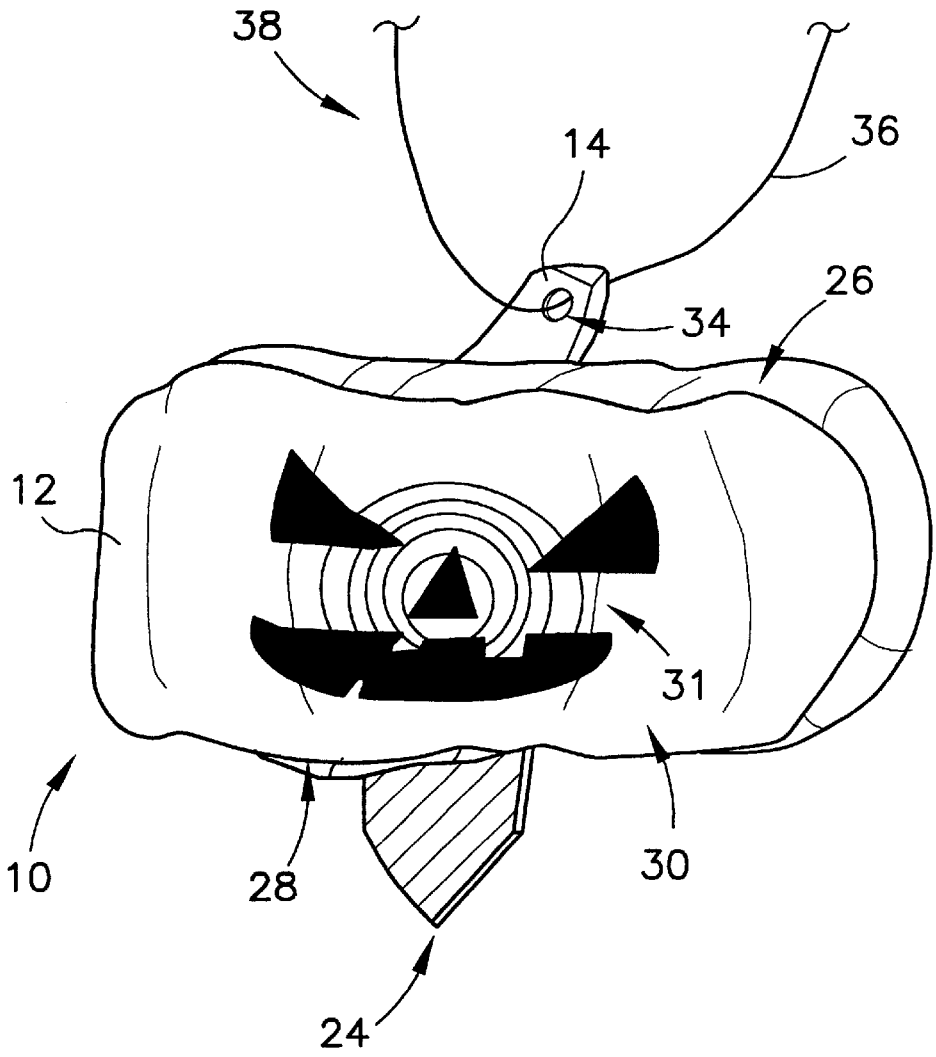
FIG. 1 illustrates a perspective view of the novel combination lighting device.

Referring to the drawings, FIG. 1 illustrates a perspective view of one embodiment of the novel combination lighting device, shown generally as 10. This device 10 may be secured inside of a carved pumpkin 11 (not show), secured onto an article of clothing 13 (not shown), or worn as a necklace 38. The instant device 10 has a front housing 12, a stem portion 14, a back panel 16 (shown in FIGS. 3–5), means 18 (shown in FIGS. 3 & 5) for lighting the front housing 12, means 20 (shown in FIGS. 3 & 5) for powering the lighting means 18, means 22 (shown in FIGS. 3–4) for activating the lighting means 18, and means 24 for removably securing the lighting device 10 within a carved pumpkin 11 or onto an article of clothing 13.

Figure 3:
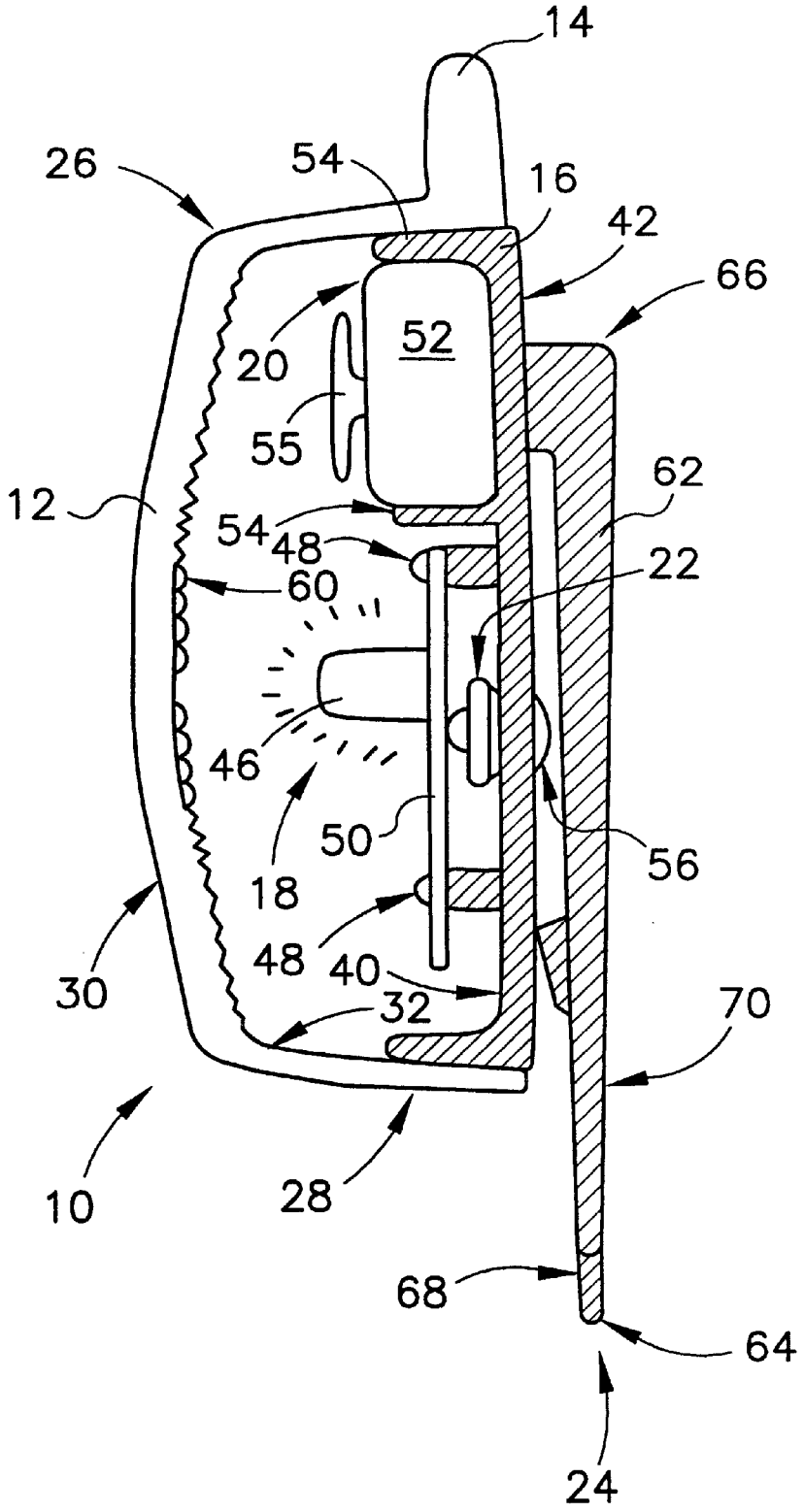
FIG. 3 shows a cross-sectional side view of the line 3—3 drawn in FIG. 2.

The front housing 12 has a top edge 26, a bottom edge 28, an outer side 30 and an inner side 32 (shown in FIG. 3). It is preferred that the front housing 12 comprises a substance which allows light to pass therethrough, such as a translucent or transparent substance. It is most preferred that the front housing 12 is translucent. Sample materials comprising the front housing 12 include plastics and polymers.

It is even more preferred that the front housing 12 comprise an orange color and a pumpkin shape to match the color and shape of a pumpkin 11. Additionally, the outer side 30 of the front housing 12 may contain a printed jack-o-lantern face 31 resembling that of a carved pumpkin 11.

Attached to the top edge 26 of the front housing 12 is a vertically extending stem portion 14 that has a horizontal aperture 34 through it. This aperture 34 allows a string 36 to pass through it so that a person may wear the lighting device 10 as a necklace 38. One of skill in the art will know that other types of necklaces 38 may be used in place of a string 36. But, for ease of use, especially for children on Halloween night, a string 36 is most practical to use as a necklace 38, as opposed to using jewelry which may be stolen.

Figure 2:
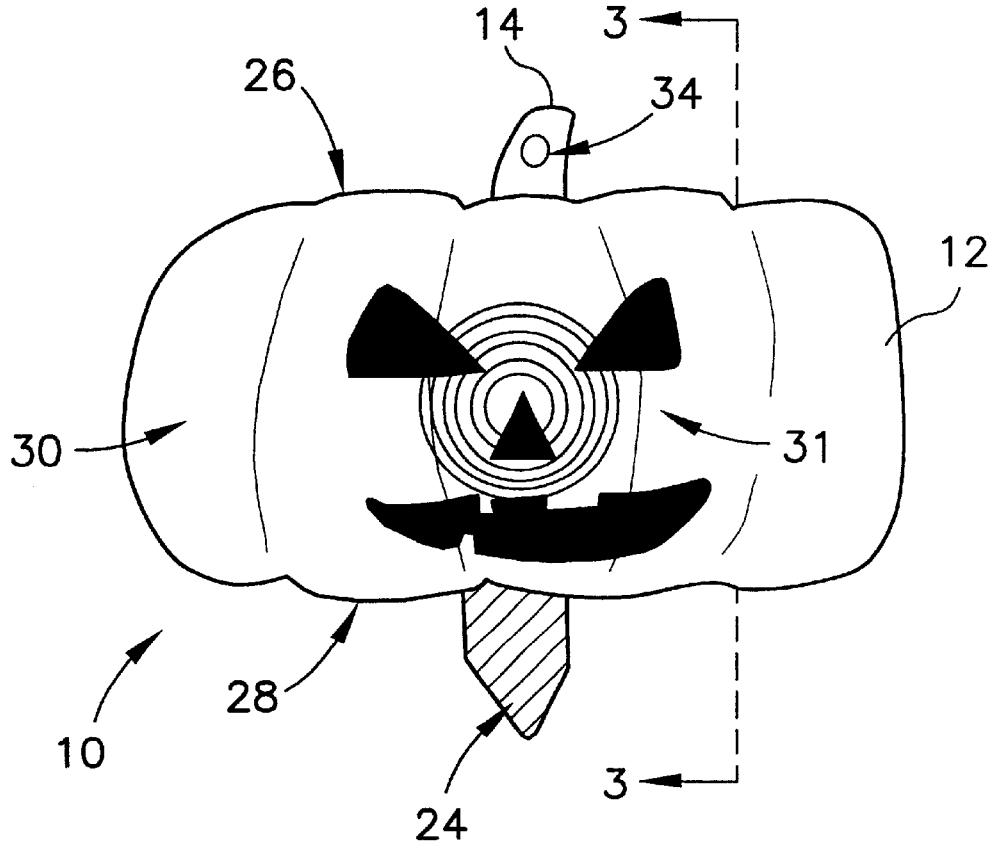
FIG. 2 illustrates a front view of the novel combination lighting device.

Referring to FIG. 2, it shows a front view of the combination lighting device 10 without a string 36 running through the aperture 34 of the stem portion 14. Now referring to FIG. 3, it shows the cross-sectional view of the inventive lighting device 10 across dotted-line 3—3 in FIG. 2. The back panel 16 of the novel device 10 has an inner side 40 and an outer side 42. As can be seen, the back panel 16 should have a size that allows it to fit within the front housing 12 such that the inner side 40 of the back panel 16 removably engages with the inner side 32 of the front housing 12. Also shown are the lighting means 18, the powering means 20, the activating means 22 and the securing means 24.

The lighting means 18 may be either a light bulb 44 (not shown) or a light emitting diode (LED) 46. The light emitted by the lighting means 18 may be either constant or flashing in a strobe-like manner. Each of these types are known in the art. The lighting means 18 is attached to the inner side 40 of the back panel 16 so that light emanating therefrom passes toward the front housing 12. Typical ways known in the art for attaching the lighting means 18 to the back panel 16 include using screws 48 to secure a plank 50 to the back panel 16 and, then, gluing the lighting means 18 to the plank 50.

The powering means 20 provides the lighting means 18 with power. Preferred powering means 20 include a battery source, the battery source may be a lithium battery. Like the lighting means 18, the powering means 20 is also secured to the inner side 40 of the back panel 16. FIG. 3 shows one battery 52 being removably secured within a cup 54 extending horizontally from the inner side 40 of the back panel 16. The batteries 52 may further be secured in the back panel 16 by using a clip member 55 that is secured to the inner side 40 of the back panel 16 with a screw 48 (not shown). The clip member 55 is preferably made of a metallic substance.

The activating means 22 in this embodiment comprises a button 56 located on the outer side 42 of the back panel 16 that is electrically connected to the lighting means 18 using circuitry 58 (not shown) that is known in the art. In operation, when the button 56 is pressed, this activates the lighting means 18 to illuminate the combination lighting device 10. As stated previously, the device 10 may be illuminated constantly or in a strobe-like manner, depending on the lighting means 18 utilized.

Still referring to FIG. 3, the inner side 32 of the front housing 12 is shown with corrugated ridges 60. These ridges 60 are used to deflect the light from the lighting means 18 so as to result in a translucent inner side 32 of the front housing 12.

FIG. 3 further illustrates the removably securing means 24 of the novel lighting device 10. In this embodiment, the securing means 24 comprises a flange member 62 having a tapering pointed end 64 and an opposing curved end 66 thereto, and further having a front side 68 and a back side 70. The front side 68 of the flange member 62 faces the outer side 42 of the back panel 16, while the opposing curved end 66 of the flange member 62 is attached to the latter. When attached in this manner, the pointed end 64 of the flange member 62 points downward. For the pointed end 64 to be effective, it should extend beyond the bottom edge 28 of the front housing 12 when the latter is removably engaged with the back panel 16. In this way, the pointed end 64 may be inserted into a carved pumpkin 11.

The flange member 62 also has another function. It may be used to secure the combination lighting device 10 to an article of clothing 13. When this is the intended function of the flange member 62, it is attached to the back panel 16 in the same manner as just described. However, this time, the flange member 62 is inserted into a shirt pocket (not shown), or another part of an article of clothing 13, via the pointed end 64 first so as to "clip" the device 10 to the article of clothing 13. This will secure the instant lighting device 10 to the article of clothing 13. Additionally, the flange member 62 may have a protruding notch 72 that aids in securing the lighting device 10 to the article of clothing 13. This notch 72 should be located on the front side 68 of the flange member 62 across from the outer side 42 of the back panel 16 so that the notch 72 will form friction to aid in securement. Convenient places on an article of clothing 13 for securement of the novel device 10 include shirt or blouse breast pockets (not shown), shirt collars (not shown), or the front pockets of pants (not shown), among other locations known in the art.

Figure 4:
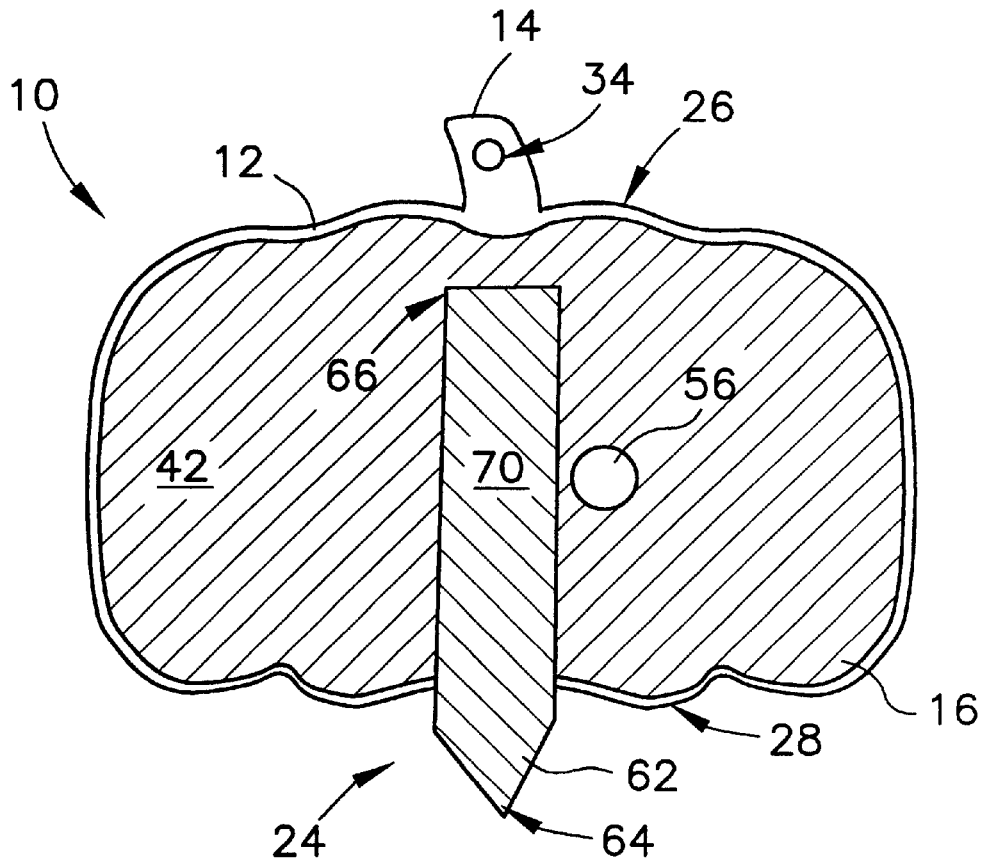

Referring to FIG. 4, it illustrates a back view of the novel combination lighting device 10. Specifically, this view shows the preferred locations of the flange member 62 and the button 56 to activate the lighting means 18 in relation to the outer side 42 of the back panel 16. Also shown is the extension of the pointed end 64 of the flange member 62 beyond the bottom edge 28 of the front housing 12 so that the pointed end 64 may be inserted into a carved pumpkin 11 properly and securely.

FIG. 5 shows the inner side 40 of the back panel 16 with emphasis on the lighting means 18 and the powering means 20. The lighting means 18 is most preferably a LED 46 that is glued to a plank 50 which, in turn, is attached to the inner side 40 of the back panel 16 using screws 48. The battery source 52 of the powering means 20 is securing within the inner side 40 of the back panel 16 using, in this preferred embodiment, both a cup 54 that surrounds the battery source 52 and a clip member 55 that keeps the battery source 52 within the cup 54. The clip member 55 is secured to the inner side 40 of the back panel 16 by using a screw 48.

Hence, while the invention has been described in connection with a preferred embodiment, it will be understood that it is not intended that the invention be limited to that embodiment. On the contrary, it is intended to cover all alternatives, modifications and equivalents as may be included within the spirit and scope of the invention as disclosed.

As to the manner of usage and operation of the instant invention, same should be apparent from the above disclosure, and accordingly no further discussion relevant to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered illustrative of only the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A combination lighting device adapted for use in a carved pumpkin, as a necklace and on an article of clothing, the combination lighting device comprising:

(a) a front housing having a top edge and a bottom edge, the housing further having an outer side and an inner side, wherein the front housing allows light to pass therethrough;

(b) a stem portion having an aperture, the stem portion being attached to the top edge of the front housing so that a piece of string may pass horizontally through the apertures for use as a necklace;

(c) a back panel having an inner side and an outer side, the back panel being sized to removably engage the inner side of the back panel with the inner side of the front housing;

(d) means for lighting the front housing, the lighting means being attached to the inner side of the back panel, wherein the lighting means emits light through the front housing when the front housing is removably engaged with the back panel;

(e) means for powering the lighting means, the powering means being removably secured within the inner side of the back panel;

(f) means for activating the lighting means, the activating means being secured to the back panel; and (g) means for removably securing the lighting device within a pumpkin or to an article of clothing.

2. The combination lighting device of claim 1 wherein the front housing comprises a translucent front housing for allowing light to pass therethrough.

3. The combination lighting device of claim 1 wherein the front housing comprises an orange-colored front housing having a pumpkin shape.

4. The combination lighting device of claim 3 wherein the outer side of the front housing comprises an outer side having a jack-o-lantern face printed thereon.

5. The combination lighting device of claim 1 wherein the lighting means comprises a light bulb.

6. The combination lighting device of claim 1 wherein the lighting means comprises a light emitting diode.

7. The combination lighting device of claim 1 wherein the powering means comprises a battery source.

8. The combination lighting device of claim 7 wherein the battery source comprises at least one lithium battery.

9. The combination lighting device of claim 1 wherein the activating means comprises a button located on the outer side of the back panel, the button being electrically connected to the lighting means using circuitry, whereby the button is pressed to activate the lighting means.

10. A combination lighting device adapted for use in a carved pumpkin, as a necklace and on an article of clothing, the combination lighting device comprising:

(a) a front housing having a top edge and a bottom edge, the housing further having an outer side and an inner side, wherein the front housing allows light to pass therethrough;

(b) a stem portion having an apertures, the stem portion being attached to the top edge of the front housing so that a piece of string may pass horizontally through the apertures for use as a necklace;

(c) a back panel having an inner side and an outer side, the back panel being sized to removably engage the inner side of the back panel with the inner side of the front housing;

(d) means for lighting the front housing, the lighting means being attached to the inner side of the back panel, wherein the lighting means emits light through the front housing when the front housing is removably engaged with the back panel;

(e) means for powering the lighting means, the powering means being removably secured within the inner side of the back panel;

(f) means for activating the lighting means, the activating means being secured to the back panel; and (g) means for removably securing the lighting device within a pumpkin or to an article of clothing, wherein the securing means comprises a flange member having a tapering pointed end and an opposing curved end, the flange member further having a front side and a back side, the front side facing the outer side of the back panel, the opposing curved end being attached to the outer side of the back panel, the pointed end extending beyond the bottom edge of the front housing when the latter is removably engaged with the back panel, whereby the pointed end can be inserted into the carved pumpkin for securing the lighting device thereto, further whereby the flange member can secure the lighting device to the article of clothing by clipping thereto.

11. The combination lighting device of claim 10 further comprising a protruding notch attached to the front side of the flange member, whereby the protruding notch better secures the lighting device to the article of clothing.

12. A combination lighting device, the combination lighting device comprising:

(a) a translucent front housing having a top edge and a bottom edge, the housing further having an outer side and an inner side, wherein the transparent front housing allows light to pass therethrough;

(b) a back panel having an inner side and an outer side, the back panel being sized to removably engage the inner side of the back panel with the inner side of the front housing;

(c) means for lighting the front housing, the lighting means being attached to the inner side of the back panel, wherein the lighting means emits light through the front housing when the front housing is removably engaged with the back panel;

(d) means for powering the lighting means, the powering means being removably secured within the inner side of the back panel;

(f) means for activating the lighting means, the activating means being secured to the back panel; and (f) means for removably securing the lighting device within a pumpkin or to an article of clothing.

13. The combination lighting device of claim 12 wherein the front housing comprises an orange-colored front housing having a pumpkin shape.

14. The combination lighting device of claim 13 wherein the outer side of the front housing comprises an outer side having a jack-o-lantern face printed thereon.

15. The combination lighting device of claim 12 wherein the activating means comprises a button located on the outer side of the back panel and extending therethrough, the button being electrically connected to the lighting means using circuitry, whereby the button is pressed to activate the lighting means.

16. The combination lighting device of claim 12 wherein the securing means comprises a clip member having a tapering pointed end and an opposing curved end, the clip member further having a front side and a back side, the front side facing the outer side of the back panel, the opposing curved end being attached to the outer side of the back panel, the pointed end extending downwardly beyond the bottom edge of the front housing when the latter is removably engaged with the back panel, whereby the pointed end can be inserted into the carved pumpkin for securing the lighting device thereto, further whereby the clip member can secure the lighting device to the article of clothing by clipping thereto.

17. The combination lighting device of claim 16 further comprising a protruding notch attached to the front side of the clip member, whereby the protruding notch better secures the lighting device to the article of clothing.

* * * * *